United States Patent [19]

Beddome et al.

[11] Patent Number: 4,560,398

[45] Date of Patent: Dec. 24, 1985

[54] AIR SEPARATION PROCESS TO PRODUCE ELEVATED PRESSURE OXYGEN

[75] Inventors: Robert A. Beddome; Harry Cheung, both of Kenmore, N.Y.

[73] Assignee: Union Carbide Corporation, Danbury, Conn.

[21] Appl. No.: 628,312

[22] Filed: Jul. 6, 1984

[51] Int. Cl.[4] ..... F25J 3/04

[52] U.S. Cl. ..... 62/29; 62/30; 62/31

[58] Field of Search ..... 62/23, 24, 25, 27, 28, 62/29, 30, 31, 32, 34, 36, 38, 44, 26

[56] References Cited

U.S. PATENT DOCUMENTS

| | | | |
|---|---|---|---|
| 2,812,645 | 11/1957 | Locklair et al. | 62/123 |
| 2,896,415 | 7/1959 | Shanley | 62/29 |
| 2,997,854 | 8/1961 | Schilling et al. | 62/29 |
| 3,210,951 | 10/1965 | Gaumer | 62/29 |
| 3,609,983 | 10/1971 | Lofredo et al. | 62/31 |
| 4,133,662 | 1/1979 | Wagner | 62/13 |
| 4,325,719 | 4/1982 | Yamazaki | 62/30 |

FOREIGN PATENT DOCUMENTS

| | | | |
|---|---|---|---|
| 2323941 | 11/1974 | Fed. Rep. of Germany | 62/29 |
| 0676829 | 7/1979 | U.S.S.R. | 62/23 |

*Primary Examiner*—S. Leon Bashore
*Assistant Examiner*—Andrew J. Anderson
*Attorney, Agent, or Firm*—Stanley Ktorides

[57] ABSTRACT

A double column air separation process which enables one to efficiently produce oxygen gas at a pressure exceeding that of the lower pressure column without compression or pumping wherein oxygen liquid hydrostatic head is employed to impart a pressure increase to the oxygen.

13 Claims, 1 Drawing Figure

AIR SEPARATION PROCESS TO PRODUCE ELEVATED PRESSURE OXYGEN

TECHNICAL FIELD

This invention relates generally to the field of cryogenic distillative air separation and more particularly is an improvement whereby oxygen gas may be produced efficiently at elevated pressure.

BACKGROUND OF THE INVENTION

The cryogenic distillation of air for separation into its components is well known. One of the most widely employed cryogenic air separation processes employs the use of a higher pressure column, in which a preliminary separation of air is made into oxygen-richer and nitrogen-richer components, and a lower pressure column, in which the final separation into product oxygen and/or product nitrogen is made. Often the two columns are in heat exchange relation and the lower pressure column is situated over the higher pressure column.

Such double column processes are employed because a single column cannot produce relatively high purities of both oxygen and nitrogen. A second column takes advantage of the shape of the nitrogen-oxygen equilibrium curve so that relatively high purities of both nitrogen and oxygen can be produced. The second column is at a lower pressure so that higher pressure nitrogen can be used to boil lower pressure oxygen due to the fact that the boiling point of nitrogen at the higher pressure is higher than the boiling point of oxygen at the lower pressure.

By the use of such a double column air separation process, feed air is separated into components with good energy efficiency and good product purity.

However, such a process requires that the products come out of the separation at relatively low pressure. This is a drawback if one desires product at elevated pressure. For example, oxygen at elevated pressure is generally required for such applications as coal conversion to synthetic fuels and metal ore refining.

Production of elevated pressure oxygen is generally accomplished by compressing the product oxygen from the lower pressure column to the desired pressure. However, such a procedure is costly both in terms of capital costs and in operating costs to run the compressor. Furthermore, such compression has further disadvantages due to the risk of oxygen supported fire in malfunctioning compression equipment. Oxygen gas compression requires special safety considerations and equipment.

Another method which is employed to produce oxygen at elevated pressure is to withdraw oxygen as liquid from the lower pressure column and to pump the liquid oxygen to a higher pressure. The oxygen is then vaporized to produce elevated pressure oxygen gas. This method satisfactorily addresses some of the safety concerns which arise with respect to compressing oxygen gas. However, such liquid pumping processes are costly from both an equipment and operating cost standpoint.

It is desirable to have a process which allows one to employ a conventional double column air separation plant and also enables one to produce oxygen gas at a pressure greater than that of the lower pressure column without need for compressing the oxygen gas or liquid from the lower pressure column.

It is therefore an object of this invention to provide an improved double column cryogenic distillative air separation process.

It is another object of this invention to provide an improved double column cryogenic distillative air separation process wherein oxygen gas is produced at a pressure exceeding that of the lower pressure column without need for compressing oxygen gas from the lower pressure column or for pumping oxygen liquid from the lower pressure column to a higher pressure.

SUMMARY OF THE INVENTION

The above and other objects which will become apparent to one skilled in the art upon a reading of this disclosure are attained by this invention which is:

In a process for the separation of feed air by countercurrent liquid vapor contact in a higher pressure column and a lower pressure column which are in heat exchange relation at a region where vapor from the higher pressure column cools to warm liquid from the lower pressure column, the improvement comprising:

(A) withdrawing liquid from said region of heat exchange relation;

(B) vaporizing said withdrawn liquid by indirect heat exchange with the major portion of the feed air, which is at a pressure substantially the same as that of the higher pressure column, at an elevation lower than said region of heat exchange relation, to partially condense said feed air;

(C) introducing at least some of the vapor portion of said partially condensed major portion of the feed air into said higher pressure column; and (D) recovering at least some of the vapor formed in step (B) at a pressure which exceeds that of the lower pressure column.

The term "indirect heat exchange", as used in the present specification and claims, means the bringing of two fluid streams into heat exchange relation without any physical contact or intermixing of the fluids with each other.

The term, "column", as used in the present specification and claims, means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith et al, page 13-3, *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation. Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns.

DETAILED DESCRIPTION

Figure 1:
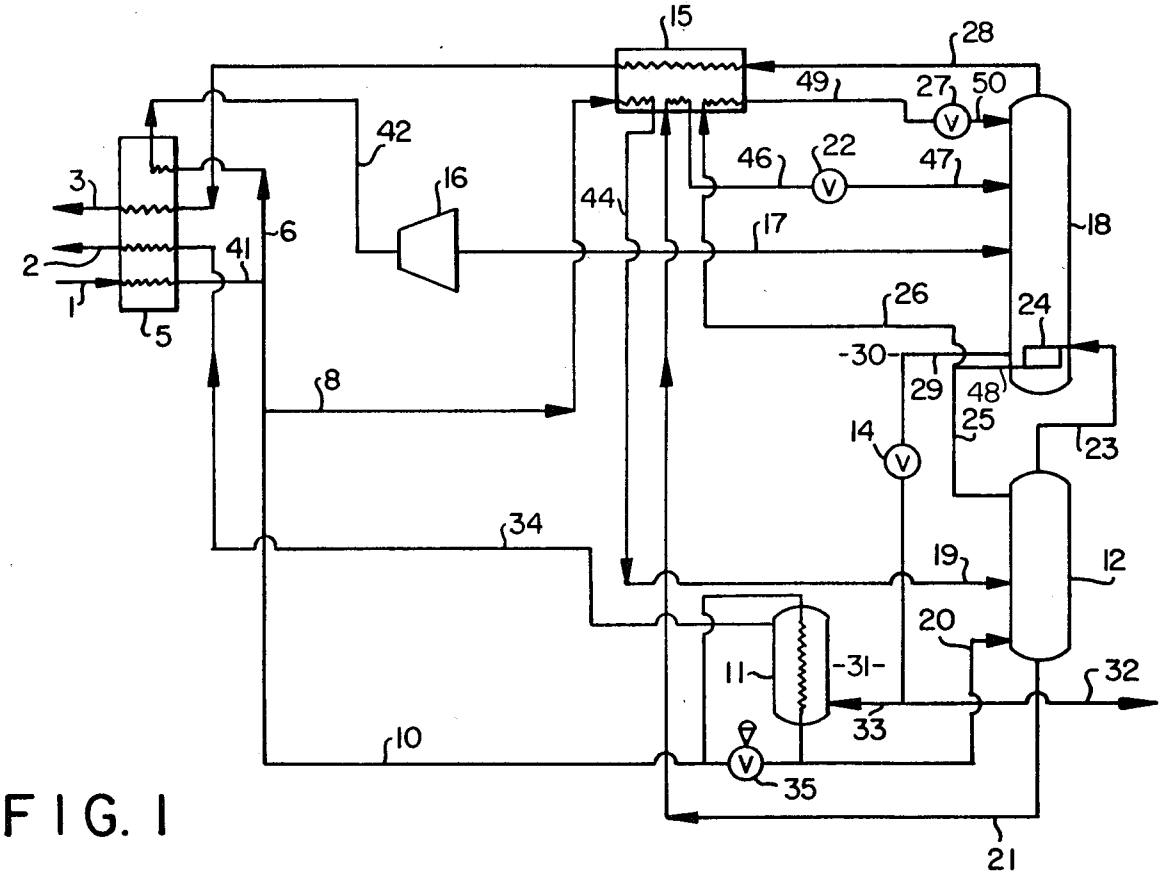
FIG. 1 is a schematic representation of one preferred embodiment of the process of this invention.

The process of this invention will be described in detail with reference to the drawing.

Referring now to FIG. 1, feed air 1, which has been cleaned of high boiling impurities such as carbon dioxide and water vapor, and has been compressed to a pressure substantially the same as that of the higher pressure column plus enough to account for line losses due to pressure drop, is cooled by passage through heat exchanger 5 against outgoing streams which will be described later.

FIG. 1 represents a preferred embodiment of the process of this invention wherein one or more small portions of the feed air are employed to accomplish functions other than the vaporization of elevated pressure oxygen. These small portions, if employed, will never aggregate to more than half of the incoming feed air.

The cooled compressed feed air 41 emerging from heat exchanger 5 is divided into the aforesaid small portions and into major portion 10 which is employed to vaporize elevated pressure oxygen. The major portion 10 may be 100 percent of the feed air if none of the aforesaid small portions are employed. The major portion 10 is never less than 50 percent of the feed air, preferably is not less than about 75 percent of the feed air, and most preferably is not less than about 85 percent of the feed air.

Feed air 41 may, if desired, be divided into streams 6 and/or 8 in addition to major portion 10. Air stream 6 is returned at least partially back through heat exchanger 5 and out as stream 42 and at least a portion of this stream is expanded for plant refrigeration through expansion turbine 16. The cooled expanded stream 17 is then fed into lower pressure column 18. If not all of stream 42 is needed for plant refrigeration, a portion may be returned to feed air stream 41. Conversely, if additional air is needed for refrigeration, an air stream may be fed directly to the turbine, i.e., without passing back through heat exchanger 5.

A portion 8 of feed air 41 may be split off and used to warm nitrogen stream 28 in heat exchanger 15. The cooled air stream 44 emerging from heat exchanger 15 is then fed into higher pressure column 12 at feed point 19.

If employed, the air stream 42 which undergoes expansion for plant refrigeration comprises from about 5 to 20 percent, preferably from 5 to 10 percent of the incoming feed air.

If employed, the portion 8 which warms outgoing nitrogen gas comprises from about 0.25 to 1.0 percent of the incoming feed air.

The aspects of the air separation process other than feed air treatment and product oxygen vaporization are operated according to conventional double column methods and one such embodiment will now be briefly described.

Feed air entering higher pressure distillation column 12 is fractionated into a nitrogen-rich vapor and an oxygen enriched liquid. Higher pressure column 12 may operate at a pressure within the range of from 40 to 150 pounds per square inch absolute (psia) and preferably within the range of from 60 to 90 psia.

Liquid oxygen-enriched stream 21 is withdrawn from column 12 and is subcooled by indirect heat exchange in heat exchanger 15 with outgoing product or waste nitrogen 28. The subcooled liquid stream is expanded through valve 22 and the expanded stream 47 is introduced into lower pressure column 18.

A nitrogen-rich vapor stream 23 is withdrawn from the high pressure column 12 and condensed against reboiling lower pressure column bottoms by passage through main condenser 24 which is located at the lower end of the lower pressure column. The condensed nitrogen-rich stream 48 is divided into stream 25 which is returned as liquid reflux to higher pressure column 12 and into stream 26 which is cooled by indirect heat exchange with nitrogen stream 28 in heat exchanger 15. The resulting cooled stream 49 is expanded through valve 27 and the resulting stream 50 is introduced as reflux to lower pressure column 18.

The streams entering lower pressure column 18 are fractionated into a nitrogen-rich vapor and an oxygen-rich liquid. Lower pressure column 18 operates at a pressure less than that of higher pressure column 12 and within the range of from atmospheric pressure to 30 psia, preferably from 12.5 to 25 psia.

Gaseous nitrogen stream 28 is withdrawn from lower pressure column 18, is warmed by passage through heat exchangers 15 and 5, and exits the air separation system as stream 3. This nitrogen stream may be totally or partially vented as waste or it may be partially or totally recovered as product nitrogen gas.

Oxygen-rich liquid collects at the bottom of lower pressure column 18. This liquid is boiled by indirect heat exchange with the nitrogen-rich vapor condensing in main condenser 24. In this way the two columns are brought into heat exchange relation at this region. The boiled off oxygen-rich vapor travels up through lower pressure column 18 as stripping vapor.

In the process of this invention, oxygen-rich liquid is withdrawn from this region of heat exchange relation. Preferably this region of heat exchange relation is at the bottom of the lower pressure column. The oxygen-rich liquid can have an oxygen concentration of from about 60 to 99 percent and generally has an oxygen concentration of from 90 to 99 percent. The withdrawn oxygen-rich liquid is at the pressure of the lower pressure column.

Referring back to FIG. 1, oxygen-rich liquid is withdrawn from lower pressure column 18 through conduit 29 and passed through flow valve 14. If desired, a small stream 32 of oxygen-rich liquid may be removed as product. Most or all of the oxygen rich liquid withdrawn from the lower pressure column is passed as stream 33 into condenser 11.

Condenser 11 is located at a lower elevation than the region of heat exchange relation between the two columns. In this way the pressure of the oxygen-rich liquid entering condenser 11 is greater than the pressure of the oxygen-rich liquid withdrawn from the lower pressure column by the amount of the hydrostatic head of the oxygen-rich liquid between these two points. The condenser 11 may be any distance lower than the main condenser 24 in the sump of the lower pressure column. In practice the air condenser 11 is generally located at ground level. The air condenser may even be physically located within the higher pressure column. An oxygen pressure increase generally up to 30 psi and typically up to 15 psi is attainable by the process of this invention.

In FIG. 1, the available hydrostatic head is equal to the elevation difference between the level of liquid oxygen withdrawal, indicated by 30, from lower pressure column 18 and the liquid level 31 in air condenser 11. The amount of pressure increase is related to the hydrostatic head by the oxygen-rich liquid density in a manner well known to those skilled in the art.

Within condenser 11 the oxygen-rich liquid is vaporized by indirect heat exchange with the major portion 10 of the feed air. As indicated earlier, major portion 10 may be 100 percent of the feed air. The resulting oxygen-rich gas is removed from condenser 11 as stream 34, warmed by passage through heat exchanger 5, and recovered as oxygen product stream 2 at a pressure which exceeds that of the lower pressure column. The product oxygen may be recovered at the pressure at which it is vaporized in condenser 11 or it may be compressed, if desired, to a higher pressure. In any event, compression costs for product oxygen are either totally eliminated are markedly reduced.

Within condenser 11 the feed air is partially condensed and the partially condensed feed air is passed as stream 20 into higher pressure column 12 wherein it undergoes separation by rectification.

The major portion of the feed air which undergoes partial condensation within condenser 11 is at a pressure which is substantially the same as that of the higher pressure column, i.e., at most 10 psi and preferably less than 5 psi greater than the pressure of the higher pressure column. In this way the partially condensed feed air emerging from condenser 11 may be fed directly into the higher pressure column without need for a pressure reduction, such as by valve expansion, which would be a process inefficiency.

Herein lies a major benefit of the process of this invention employing the major portion of the feed air as the medium to vaporize the liquid oxygen. Were a minor part of the feed air employed to carry out this function, that minor part would first require pressurization in excess of that of the higher pressure column in order to completely vaporize the liquid oxygen. This would mean that the air emerging from the condenser would have to be reduced in pressure prior to introduction into the higher pressure column, resulting in a process inefficiency.

Furthermore, were a minor part of the feed air employed to vaporize the liquid oxygen, it is quite likely that all of such minor part would condense. This is undesirable. A partial condensation of feed air in condenser 11 serves as a first separation step so that the partially condensed feed air entering the higher pressure column has effectively gone through one equilibrium stage. This further enhances the efficiency of the process of this invention. By passing the major portion of the feed air through condenser 11, the process of this invention insures that the air emerging from condenser 11 is only partially condensed and thus the efficiency of the process is increased. Generally from about 20 to 35 percent of the major portion of the feed air will be condensed against vaporizing oxygen within condenser 11.

As shown in FIG. 1, the feed stream 20 is introduced into higher pressure column 12 near the bottom of the column where liquid to be transferred to the lower pressure column collects. As can be appreciated by one skilled in the art, the base of higher pressure column 12 is acting as a phase separator for the partially condensed feed air. An equivalent embodiment would comprise a distinct phase separation in line 20. The vapor phase from the separator would be fed to column 12 and at least some, and preferably all, of the liquid phase from the separator would join bottom liquid 21 directly for transfer to the lower pressure column 18.

Furthermore, not all of the vapor portion of the partially condensed feed air need be introduced into the higher pressure column. For example, some of this vapor portion may be expanded and introduced into the lower pressure column. This expanded stream may be employed to provide plant refrigeration.

For the successful operation of air condenser 11, the dew point of the pressurized feed air 10 must be high enough to vaporize the pressurized oxygen-rich liquid 33. However, since it would generally be impractical to compress the feed air beyond that desired for the double column operation, all of the available hydrostatic head might not be utilized to maximize oxygen pressure. The pressure of the oxygen-rich liquid may be controlled by valve 14, which imparts a pressure drop varying with position.

For satisfactory operation of the air condenser 11, the liquid level 31 in the condenser 11 should be maintained at about 50 to 90 percent of the maximum and preferably is about 65 percent of the maximum.

FIG. 1 illustrates a convenient arrangement which may be used when it is desired that a portion or all of feed air 10 bypass air condenser 11. Such a time might be when the plant is starting up and it is desired to build up the liquid level in condenser 11. In such a situation, bypass valve 35 is opened and the air stream 10 partially or totally bypasses condenser 11 prior to entering column 12. When the liquid level in condenser 11 has reached the desired level or the system is otherwise back to normal, bypass valve 35 is closed and normal operation of the process is started or resumed. Of course, bypass valve 35 is not necessary for the successful operation of the process.

In Table I there is listed the results of a computer simulation of the process of this invention carried out in accord with the FIG. 1 embodiment. The higher pressure column is operated at a pressure of about 75 psia and the lower pressure column is operated at a pressure of about 19 psia. The oxygen product is at 95.0 percent purity. The stream numbers in Table I correspond to those of FIG. 1. The designation MCFH means thousand cubic feet per hour at standard conditions (14.696 psia and 70° F.) and the temperature is reported in degrees Kelvin.

TABLE I

| Stream | Flow (MCFH) | Pressure (PSIA) | Temperature (°K.) |
|---|---|---|---|
| 1 | 1929 | 84.1 | 296 |
| 2 | 422 | 23.4 | 294 |
| 3 | 1507 | 14.4 | 294 |
| 6 | 149 | 84.0 | 177 |
| 8 | 18 | 84.0 | 101 |
| 10 | 1769 | 76.0 | 101 |
| 17 | 142 | 20 | 128 |
| 20 | 1769 | 75 | 97.8 |
| 29 | 422 | 20.6 | 93.6 |
| 33 | 422 | 27.5 | 93.6 |

In the simulation reported in Table I the available hydrostatic head is 26.4 feet. Assuming the density of the oxygen-rich liquid from the lower pressure column to be 70 pounds per cubic foot, the maximum obtainable pressure increase is about 13 psi. However, only about 6.9 psi of the available pressure increase is utilized because of the relatively low feed air pressure in the air condenser. The heat exchange in the air condenser results in the liquefaction of about 30 percent of the feed air passing through the condenser.

By the use of the process of this invention, one can now efficiently increase the pressure of product oxygen over that of the lower pressure column without need for compressing oxygen gas or pumping oxygen liquid from the lower pressure column.

Although the process of this invention has been described in detail with reference to a preferred embodiment, it is recognized that there are other embodiments of this invention which are within the scope of the claims.

We claim:

1. In a process for the separation of feed air by countercurrent liquid vapor contact in a higher pressure column and a lower pressure column which are in heat exchange relation at a region where vapor from the higher pressure column cools to warm liquid from the lower pressure column, the improvement, enabling efficient production of oxygen gas at a pressure greater than that of the lower pressure column without the need for compressing oxygen gas or pumping oxygen liquid from the lower pressure column to a higher pressure, comprising (A) withdrawing liquid from said region of heat exchange relation and passing the withdrawn liquid to an elevation lower than said region of heat exchange relation to create a hydrostatic head and thereby increase the pressure of the withdrawn liquid;

(B) vaporizing said withdrawn liquid at the elevated pressure caused by said hydrostatic head by indirect heat exchange with the major portion of the feed air, which is at a pressure substantially the same as that of the higher pressure column, to partially condense said feed air, thereby effecting a first separation step of the major portion of the feed air;

(C) introducing at least some of the vapor portion of said partially condensed major portion of the feed air into said higher pressure column; and (D) recovering at least some of the vapor formed in step (B) at a pressure which exceeds that of the lower pressure column.

2. The process of claim 1 wherein all the partially condensed feed air is introduced into the higher pressure column.

3. The process of claim 1 wherein a portion of the feed air, comprising from about 5 to 20 percent of the feed air, is expanded and then introduced into the lower pressure column.

4. The process of claim 1 wherein said major portion of the feed air comprises at least 75 percent of the feed air.

5. The process of claim 1 wherein said major portion of the feed air comprises from about 85 to 100 percent of the feed air.

6. The process of claim 1 wherein said higher pressure column is operating at a pressure within the range of from 40 to 150 psia.

7. The process of claim 1 wherein said lower pressure column is operating at a pressure within the range of from atmospheric pressure to 30 psia.

8. The process of claim 1 wherein the liquid withdrawn from the region of heat exchange relation in step (A) has an oxygen concentration of from 60 to 99 mole percent.

9. The process of claim 1 wherein from about 20 to 35 percent of the major portion of the feed air is condensed in step (B).

10. The process of claim 1 further comprising compressing the vapor recovered in step (D) to a still greater pressure.

11. The process of claim 1 wherein the partially condensed feed air is separated into vapor and liquid portions and at least some of the vapor portion is introduced into the higher pressure column.

12. The process of claim 1 wherein all of the vapor portion of the partially condensed major portion of the feed air is introduced into the higher pressure column.

13. The process of claim 1 wherein a part of the vapor portion of the partially condensed major portion of the feed air is expanded and introduced into the lower pressure column.

* * * * *